US009121147B2

(12) United States Patent
Karsten et al.

(10) Patent No.: US 9,121,147 B2
(45) Date of Patent: Sep. 1, 2015

(54) ROADWAY GRINDER

(71) Applicant: Interstate Improvement, Inc., Faribault, MN (US)

(72) Inventors: Dale Karsten, Waseca, MN (US); Patricia Knish, Lonsdale, MN (US); Steven Knish, Lonsdale, MN (US)

(73) Assignee: Interstate Improvement, Inc., Faribault, MN (US)

( * ) Notice: Subject to any disclaimer, the term of this patent is extended or adjusted under 35 U.S.C. 154(b) by 21 days.

(21) Appl. No.: 13/950,167

(22) Filed: Jul. 24, 2013

(65) Prior Publication Data

US 2014/0270952 A1 Sep. 18, 2014

Related U.S. Application Data

(60) Provisional application No. 61/783,862, filed on Mar. 14, 2013.

(51) Int. Cl.
*E01C 23/088* (2006.01)

(52) U.S. Cl.
CPC ..... *E01C 23/088* (2013.01)

(58) Field of Classification Search
USPC ..... 299/36.1, 39.1, 39.2, 39.4; 404/94
IPC ..... E01C 23/088,23/127, 23/0933
See application file for complete search history.

(56) References Cited

U.S. PATENT DOCUMENTS

| | | | | | |
|---|---|---|---|---|---|
| 2,076,370 | A * | 4/1937 | Hollingshead | 404/94 |
| 3,156,231 | A * | 11/1964 | Harding, Jr. | 299/39.4 |
| 3,409,330 | A * | 11/1968 | Hatcher et al. | 299/39.4 |
| 3,694,033 | A * | 9/1972 | Rowley et al. | 299/39.4 |
| 4,256,344 | A * | 3/1981 | Hatcher | 299/39.4 |
| 5,492,431 | A | 2/1996 | Rasmussen et al. | |
| 5,676,490 | A * | 10/1997 | Nelson | 404/94 |
| 6,052,964 | A | 4/2000 | Ferm et al. | |
| 6,312,541 | B1 | 11/2001 | Hemphill | |
| 6,364,419 | B1 | 4/2002 | Cannizzo et al. | |
| 6,532,714 | B1 | 3/2003 | Ferm et al. | |
| 6,953,303 | B1 | 10/2005 | Chase et al. | |
| 7,097,383 | B1 | 8/2006 | Chase et al. | |
| 7,644,994 | B2 * | 1/2010 | Busley et al. | 299/39.4 |
| 7,837,276 | B2 | 11/2010 | Kraemer et al. | |
| 7,901,010 | B2 * | 3/2011 | Busley et al. | 299/36.1 |
| 8,025,342 | B2 | 9/2011 | Kraemer et al. | |
| 8,905,488 | B2 * | 12/2014 | Schafer et al. | 299/39.4 |

* cited by examiner

*Primary Examiner* — Gary Hartmann
(74) *Attorney, Agent, or Firm* — Schwegman Lundberg & Woessner, P.A.

(57) ABSTRACT

An example includes a concrete grinding apparatus with a jackshaft configuration to efficiently transmit torque from an engine to a grinding arbor. An example includes a method of grinding a road lane in two passes. An example includes a vacuum system to generate vacuum with a centrifugal pump to collect debris and cool a grinding arbor.

9 Claims, 12 Drawing Sheets

ROADWAY GRINDER

RELATED APPLICATIONS

This patent application claims the benefit of priority to U.S. Provisional Patent Application Ser. No. 61/783,862, filed on Mar. 14, 2013, which is incorporated herein by reference in its entirety.

BACKGROUND

Concrete grinders are used for grinding concrete and asphalt surfaces to remove irregularities in the road surface, to provide texture to the surface to prevent skidding. Grinding and texturing are used on concrete surfaces including roads and streets, airport runways and bridge decks, industrial plants, stock pens and barns. The diamond tip blades that are used to grind the concrete or asphalt surfaces are mounted on a rotating arbor. Typical grinding machines have the arbor mounted on an under carriage so that both ends of the arbor are supported by bearing assemblies capable of sufficiently supporting the arbor while enduring the high stresses associated with concrete grinding. Such grinders are large, heavy machines with sufficient mass to impart the high forces necessary for effective concrete grinding.

Smaller concrete saws are utilized to maintain expansion joints in the roadway and to separate damaged sections of concrete for easy removal. Such saws typically have a narrow cut and do not have sufficient power or mass for concrete grinding. Other specialized grinders are used to create slots for reflectors or to create rumble strips.

An example grinder is shown in U.S. Pat. No. 4,516,808 assigned to MU, Inc. As referenced in that disclosure, "when a paved surface is being ground, it is usually necessary to make more than one pass across the surface with the grinding units. It is a constant problem to insure that the grinding depth of the grinding unit is adjusted so that side-by-side grinding paths in the paved surface are level at the intersection of the two paths."

Another example grinder is shown in U.S. Pat. No. 5,161,910, assigned to Diamond Surface, Inc. As referenced in that disclosure, "the power supplied from the mechanical drive limits the torque supplied to the arbor. The width of the arbor cutting surface is then limited as greater power is required as more blades are added for a longer cutting surface. Because of power considerations, grinders have heretofore been limited to arbors having a three foot cutting width. The width of the cutting path affects the time required to perform the grinding or grooving work. When grinding and grooving are performed, adjoining cuts must be precisely aligned to ensure proper cutting depth and an even pavement surface. The alignment process for each pass and added cutting passes due to narrower cutting heads greatly increase the time required for grinding."

A further example grinder is shown in U.S. Pat. Appln. No. 2010/0109421, also assigned to Diamond Surface, Inc. As recited in that patent, "a grinding assembly may take the form of grooving blades, a single blade for cutting slots in the pavement, or other configurations with radial blades that require cooling and/or dust control. In many conventional configurations, the arbor may take on a variety of typical widths, generally extending from 2-4 feet."

These above grinding and cutting devices are not suited for performing certain grinding functions.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
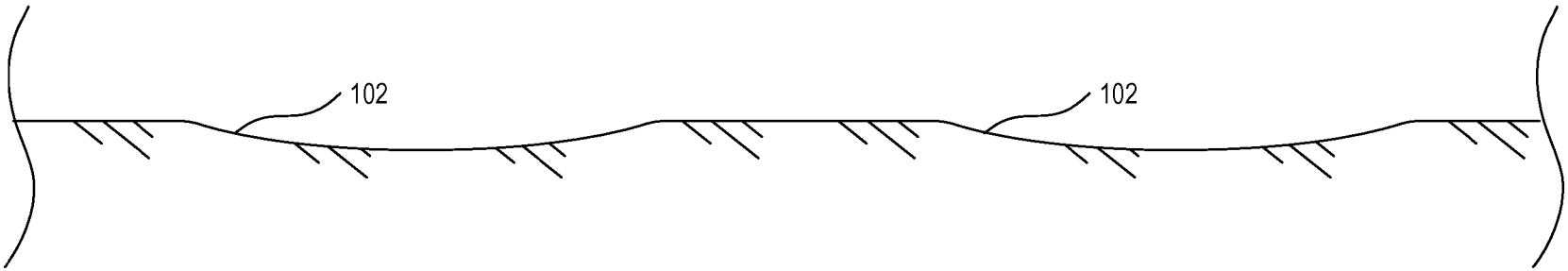
FIG. 1 is a cross-section of a road lane showing defects, according to an example.

FIG. 1 is a cross-section of a road lane showing defects, according to an example. Concrete roadways have superior wear characteristics as compared to other surfaces, such as asphalt, but like all roadways, they must be reconditioned from time to time. One wear pattern frequently experienced is one or more ruts 102 traced where automobile tires frequently pass.

Figure 2:
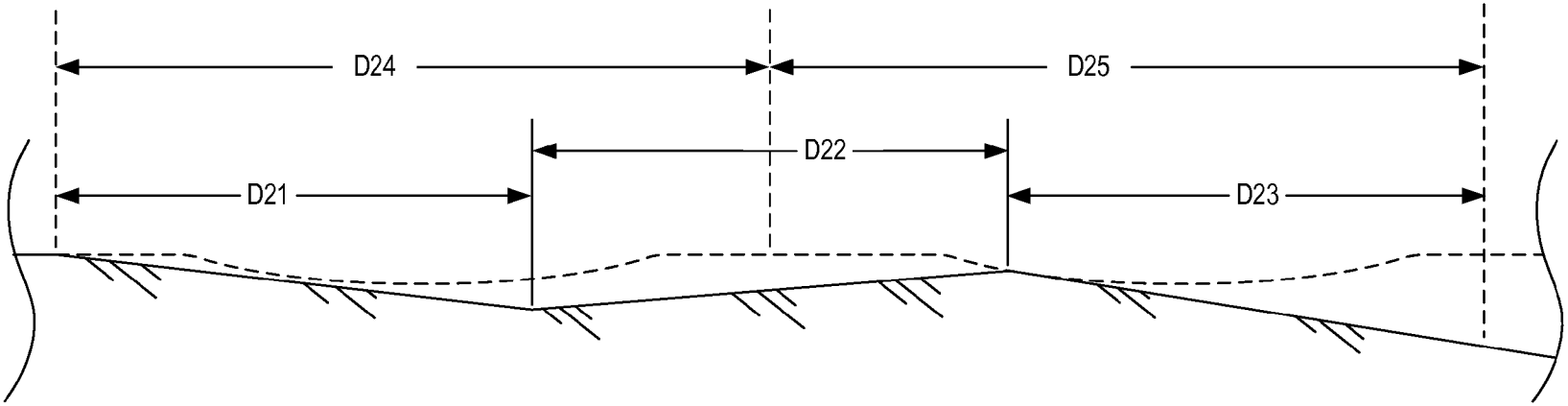
FIG. 2 is a cross-section of a road lane ground with traditional grinders.

FIG. 2 is a cross-section of a road lane ground with traditional grinders. The scale is exaggerated to show effect. A traditional approach to reconditioning such defects has been to grind the roadway as illustrated. Lanes such as the lane illustrated, including D24 and D25, can be from 12 ft. to 14 ft. in width. Traditional grinders, unfortunately, have only been able to grind a lane 3-4 ft. at a time, as evidenced in the quoted portions in the BACKGROUND section, above. Thus, the grinding takes place along D21, D22 and D23 in three passes. Such an approach has become a mainstay in that it has even been promulgated to certain state regulations. See, for example, Contract Provisions and Plans for Construction of I-5 MP144.69 to MP 173.15, which recites, "The final leveling grind shall be done with a 4 ft wide grinders [sic]," issued as part of project no. IM-0053(961) by the Washington State Department of Transportation. There are shortcomings to the 3 ft.-4 ft. approach. Traditional grinding machines are unable to do better than variants of the pattern shown in the illustration, due to limitations of their constructions. As can be seen, the resulting roadway can be non-planar, and can even result in tire paths positioned on inclines of similar slopes, which can urge a car to travel down the slow leading to an unpleasant driving experience. Further, roads can only be closed for so long. For example, a road may be closed only for 6-8 hours according to some standards. Using a 3-pass system ultimately means less road can be reconditioned per grinder, adding cost and delaying projects. The present methods and apparatus address this problem.

Figure 3:
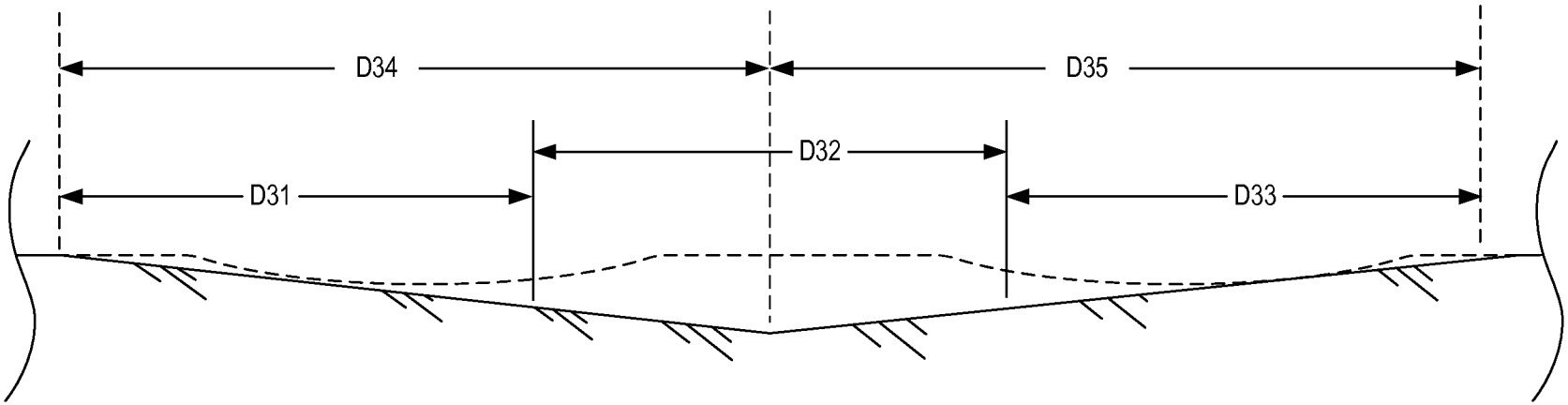
FIG. 3 is a cross-section of a road lane ground with a grinder of the present subject matter to define a concave shape, according to an example.

FIG. 3 is a cross-section of a road lane ground with a grinder of the present subject matter to define a concave shape, according to an example. The scale is exaggerated to show effect. A method of grinding a road lane in two passes can include aligning a concrete grinder having a grinding arbor sized to extend from a left edge of the lane to a center, spanning D34, to cover a first half-lane to a first substantially flat surface. A method can include aligning a concrete grinder having a grinding arbor such that the grinding arbor extends from a right edge, of the lane, opposite the left edge, to the center of the lane, spanning D35, to cover a second half-lane adjacent the first half-lane, and grinding the second half-lane to a second substantially flat surface that intersects with the first substantially flat surface. Of course the two surfaces can be coplanar, but the illustration shows that even when they are not, a superior roadway results, at least because any tendency for a wheel to descend one slope can be counteracted by an opposite wheel's tendency to descent down a slope oriented in the other direction. It should be noted that operators can easily align a subsequent grinding operation to a previous grinding operation so the panels meet at a seam line, as illustrated, avoiding a seam ledge.

Figure 4:
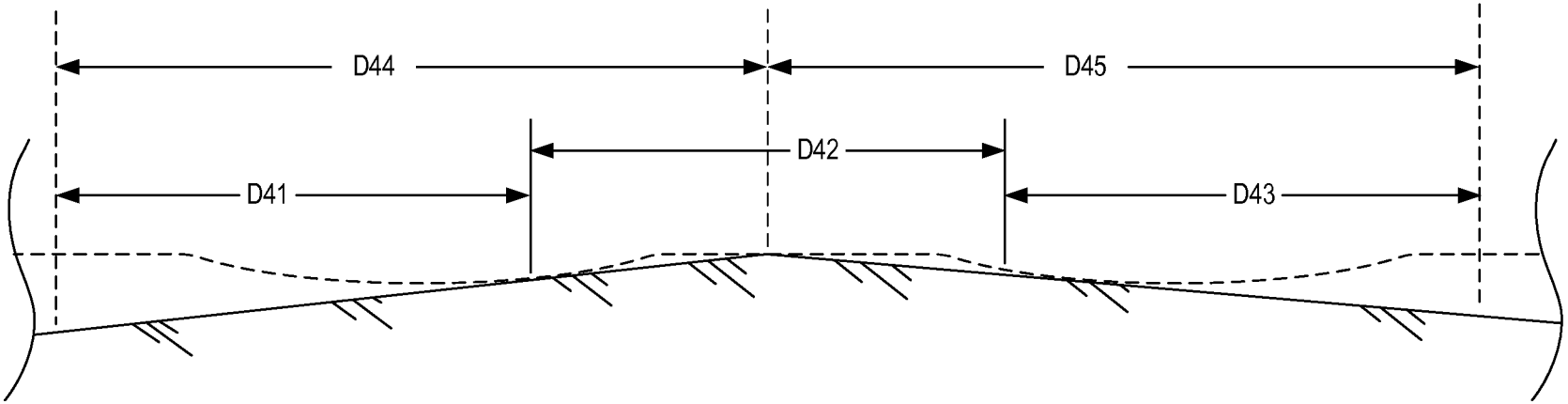
FIG. 4 is a cross-section of a road lane ground with a grinder of the present subject matter to define a convex shape, according to an example.

FIG. 4 is a cross-section of a road lane ground with a grinder of the present subject matter to define a convex shape, according to an example. The scale is exaggerated to show effect. A method of grinding a road lane in two passes can include aligning a concrete grinder having a grinding arbor sized to extend from a left edge of the lane to a center, spanning D44, to cover a first half-lane to a first substantially flat surface. A method can include aligning a concrete grinder having a grinding arbor such that the grinding arbor extends from a right edge, of the lane, opposite the left edge, to the center of the lane, spanning D45, to cover a second half-lane adjacent the first half-lane, and grinding the second half-lane to a second substantially flat surface that intersects with the first substantially flat surface.

Figure 5:
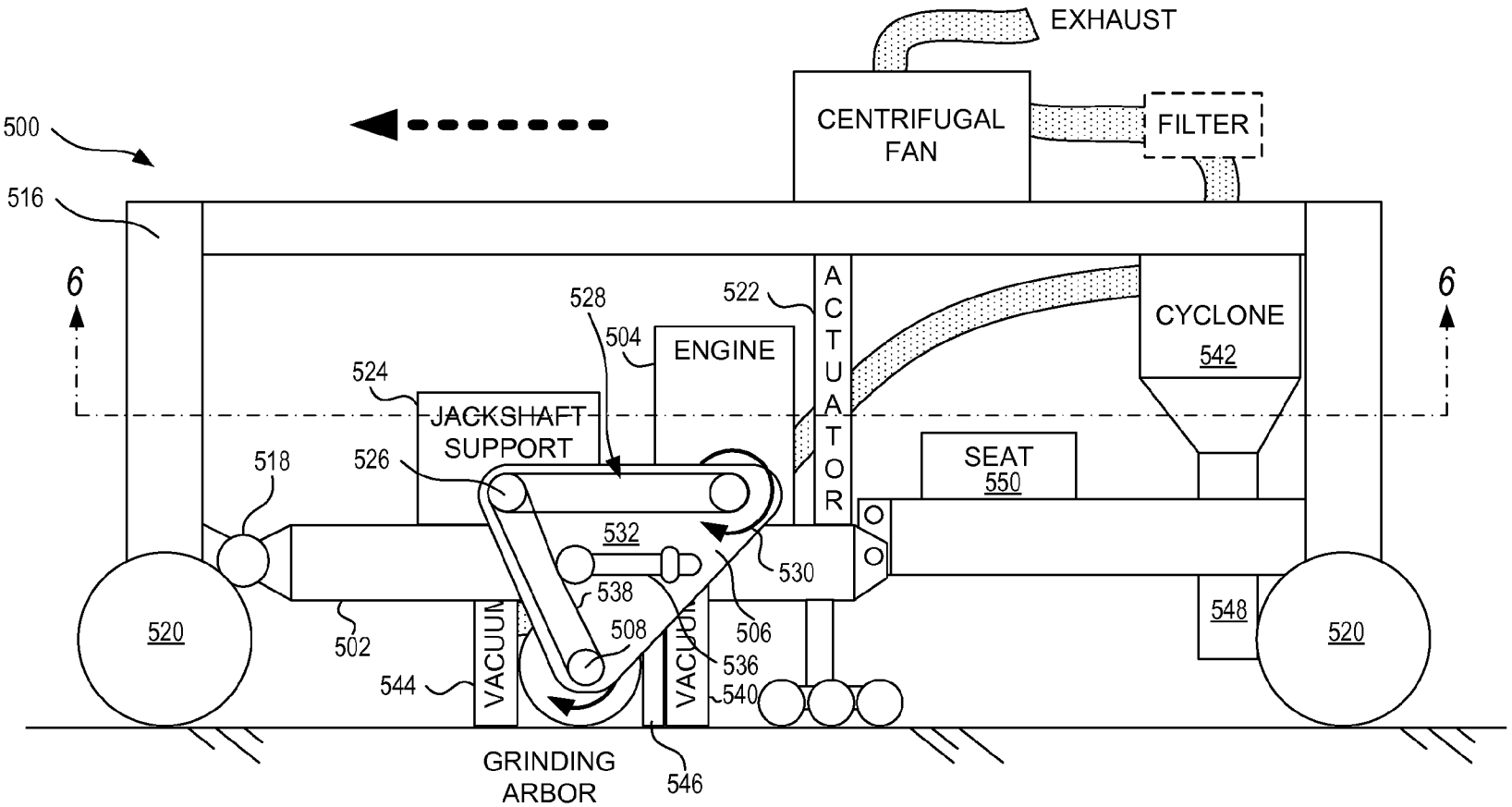
FIG. 5 is a side view of a concrete grinding apparatus including a jackshaft drive, according to an example.
Figure 6:
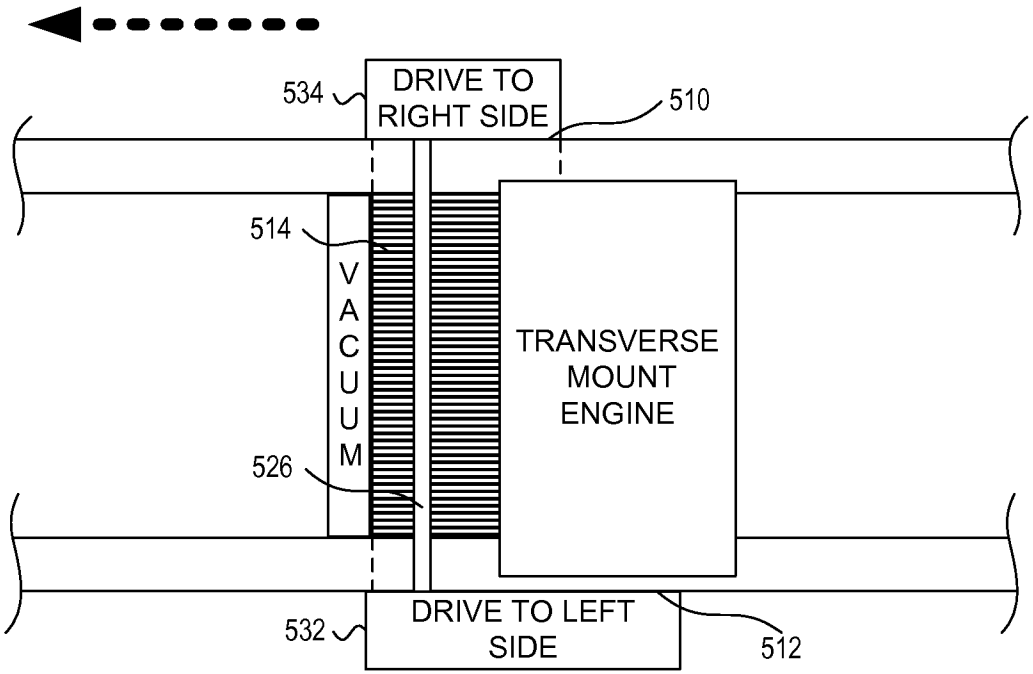
FIG. 6 is a top view cross-section taken at line 6-6 in FIG. 5.

FIG. 5 is a side view of a concrete grinding apparatus including a jackshaft drive, according to an example. FIG. 6 is a top view cross-section taken at line 6-6 in FIG. 5. A concrete grinding apparatus 500 can include a grinder frame 502. Wheels can support the grinding frame. An engine 504 can be mounted transversely across the grinding frame 502. A half-lane grinding arbor support assembly 506 can be mounted downward from the grinding frame 502. A half-lane grinding arbor 508 can be mounted to the half-lane grinding arbor support assembly 506, the half-lane grinding arbor having an arbor with a first end 510 and a second end 512 and a plurality of cutting blades 514 can be mounted along the arbor proximal to one another. The arbor can have an 8" diameter, but the present subject matter is not so limited.

The half-lane grinding arbor support can be vertically adjustable. A second frame 516 can be coupled to the grinding frame via a pivot 518. The second frame can extend 516 over the grinding frame 502, the second frame can include a prime mover (not pictured) to drive wheels 520 of the second frame to move the concrete grinding apparatus 500. An actuator 522 can be coupled between the second frame 516 and the grinding frame 502, with the second frame 516 bearing down on the actuator 522 and the grinding frame 522 to urge the grinding frame 502 downward from the second frame.

A jackshaft support assembly 524 can be mounted to the grinding frame 502. A jackshaft 526 can be coupled to the jackshaft support assembly 524 and extend transversely across the grinding frame. A jackshaft transmission 528 can be coupled to the engine 504 to translate an engine moment 530 to a jackshaft moment parallel the engine moment 530. A first grinding arbor transmission 532 can be mounted to the grinding frame 502 and can be coupled between a first end of the jackshaft 510 and the grinding arbor to translate the jackshaft moment to a first half-lane grinding arbor moment parallel the engine moment the jackshaft moment. A second grinding arbor transmission 534 can be mounted to the grinding frame and can be coupled between a second end of the jackshaft and the grinding arbor to translate the jackshaft moment to a second half-lane grinding arbor moment parallel the engine moment the jackshaft moment. The jackshaft transmission can include a belt drive. A tensioner 536 can be disposed against the belt 538 to tension the belt 538. The grinding arbor, the jackshaft and the engine each rotate around parallel axes. Note that the transmission can include a hydraulic pump, and comprising a hydraulic motor can be coupled to the hydraulic pump to power the centrifugal vacuum pump.

A vacuum shroud 540 can be positioned proximal a rear of the grinding arbor 508. A debris collector 542 can be placed in fluid communication with the vacuum shroud, and a centrifugal vacuum pump to apply a vacuum to the debris collector and thereby to the vacuum shroud, wherein the vacuum shroud is positioned near the grinding arbor to draw air across the grinding arbor to cool the grinding arbor and to collect debris from the grinding arbor.

The centrifugal pump can perform better than a positive displaconcrete vacuum system, at least because the positive vacuum system does not well tolerate debris. As the concrete grinders of the present subject matter generate large amounts of debris, positive displaconcrete systems can wear out prematurely. Centrifugal vacuum pumps examples include a squirrel cage fan.

The vacuum shroud 540 can be a first vacuum shroud, and some systems can include a second vacuum shroud 542 disposed in front of the grinding arbor in fluid communication with the debris collector. The second vacuum shroud can be coupled in fluid communication with the first vacuum shroud via a conduit to communicate vacuum from the debris collector, through the first shroud to the second shroud. This conduit can be of a smaller diameter than a main conduit coupling the first vacuum shroud to the debris collector. A vacuum shroud can be laterally centered on the grinding arbor.

A liquid sprayer 546 can spray a rear portion of the grinding arbor with coolant. The liquid sprayer can include a water sprayer. A trash pump 548 can be coupled to an exit of the debris collector to pump debris away from the debris collector. An operator seat 550 can be positioned at a side of the grinding frame near the grinding arbor and behind the grinding arbor.

Figure 7:
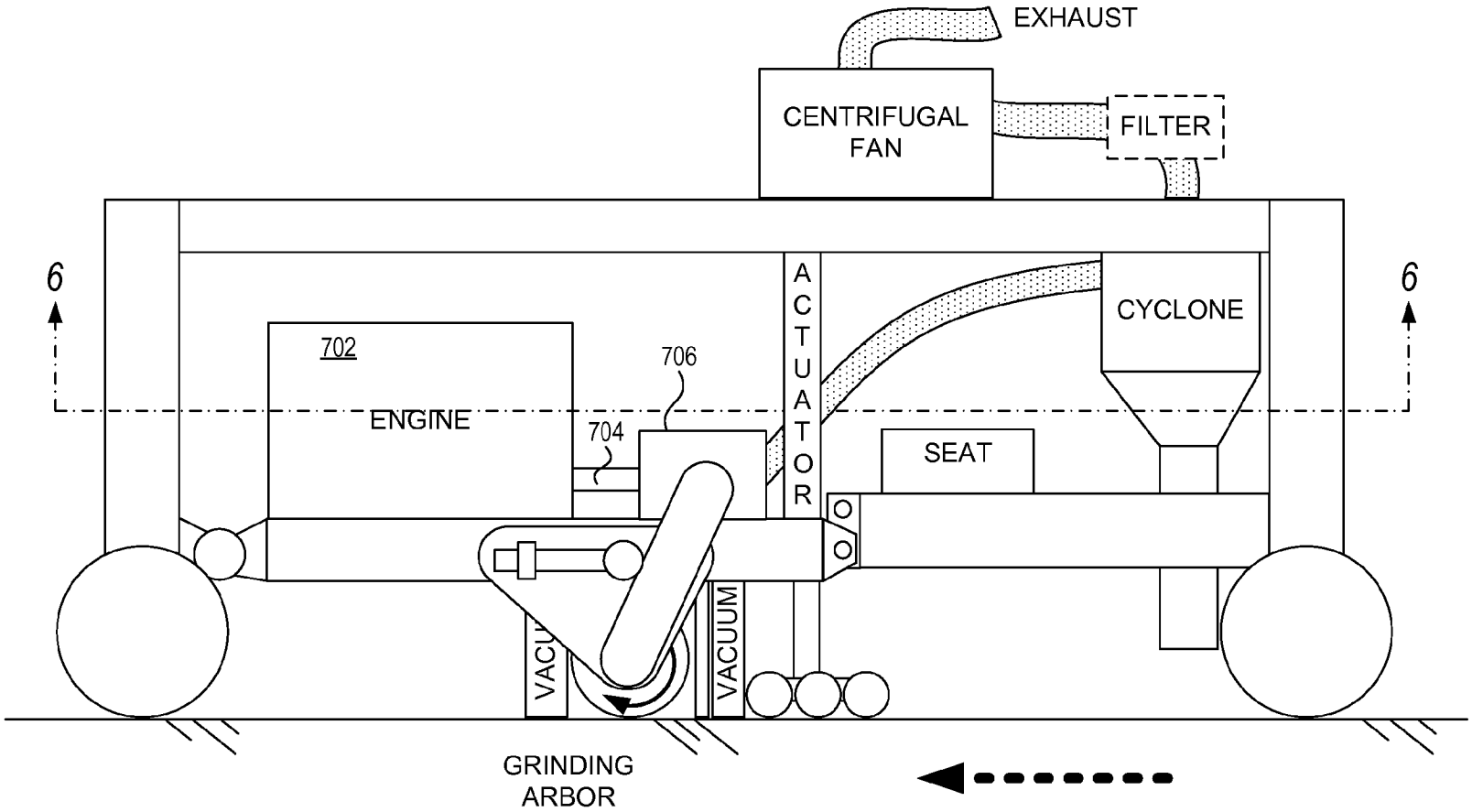
FIG. 7 is a side view of a concrete grinding apparatus including a right-angle drive, according to an example.
Figure 8:
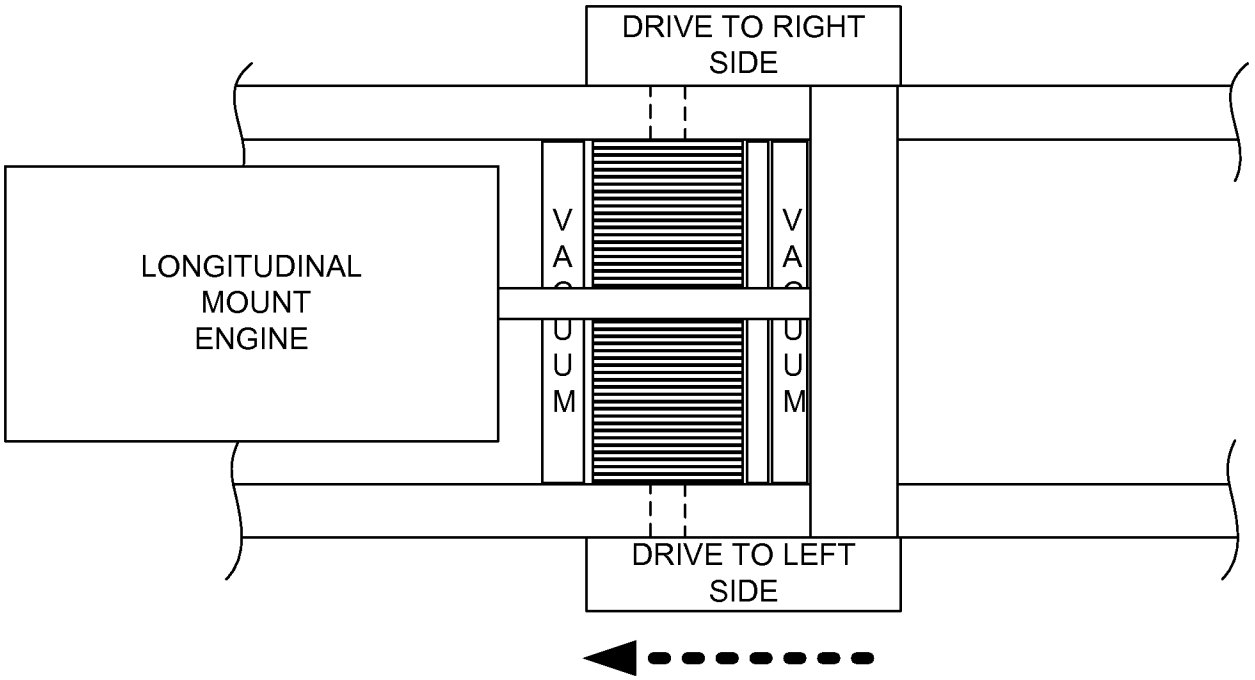
FIG. 8 is a top view cross-section taken at line 8-8 in FIG. 7.

FIG. 7 is a side view of a concrete grinding apparatus including a right-angle drive, according to an example. FIG. 8 is a top view cross-section taken at line 8-8 in FIG. 7. The example differs from the configuration in FIG. 5 at least because the engine is mounted longitudinally with respect to the grinding frame. A driveshaft 704 can coupe the engine to a transmission 706.

The transmission is to translate the engine moment from around a longitudinal axis of the grinding frame, parallel a direction of lane travel, to transverse the longitudinal axis. Accordingly, the transmission 706 can behave like a right-angle transmission, a common example of which is a solid axle for an automobile. Thus, the transmission includes a central ring and pinion, with the pinion can be coupled to the driveshaft to drive a pair of axles extending opposite sides of the grinding frame to each of the first grinding arbor transmission and the second grinding arbor transmission.

Alternatively, the transmission can include a hydraulic pump, and one or more of the grinding arbor transmissions can include a hydraulic motors coupled to the hydraulic pump.

Figure 9B:
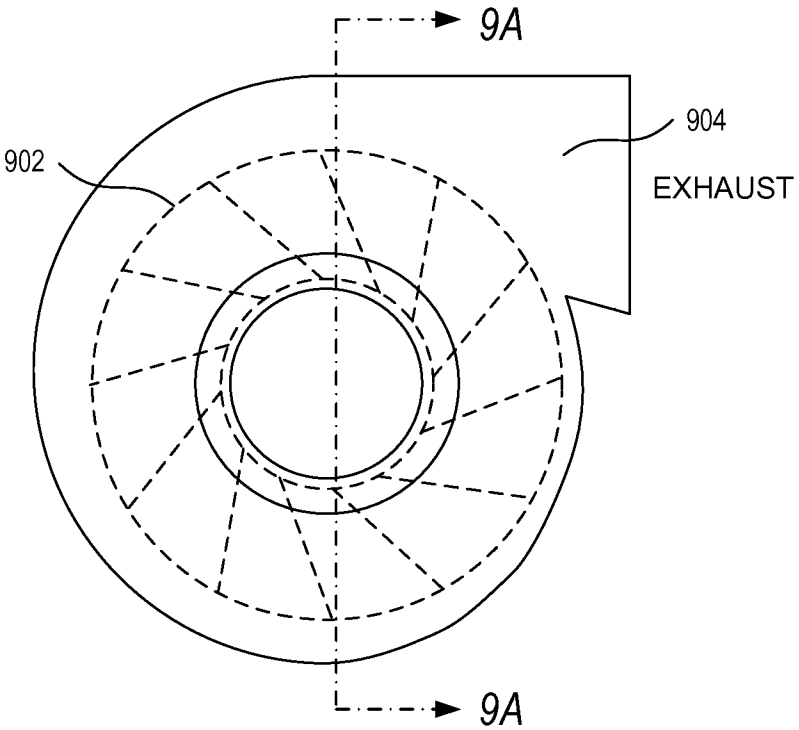
FIGS. 9A and 9B show views of an example of a centrifugal vacuum pump.
Figure 9A:
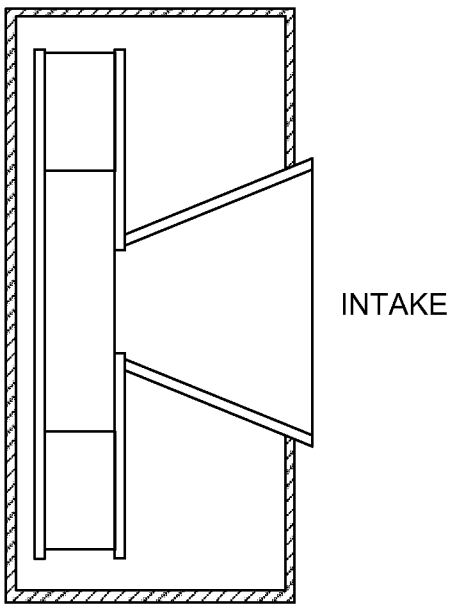

FIGS. 9A and 9B show views of an example of a centrifugal vacuum pump. As an impellor 902 spins, air is forced out the exhaust 904. The illustrated fan is just one type of centrifugal fan, and others can be used. The centrifugal fans accommodate debris better than do positive displaconcrete fans, which have rotors with delicate and precise finishes on them.

Figure 10:
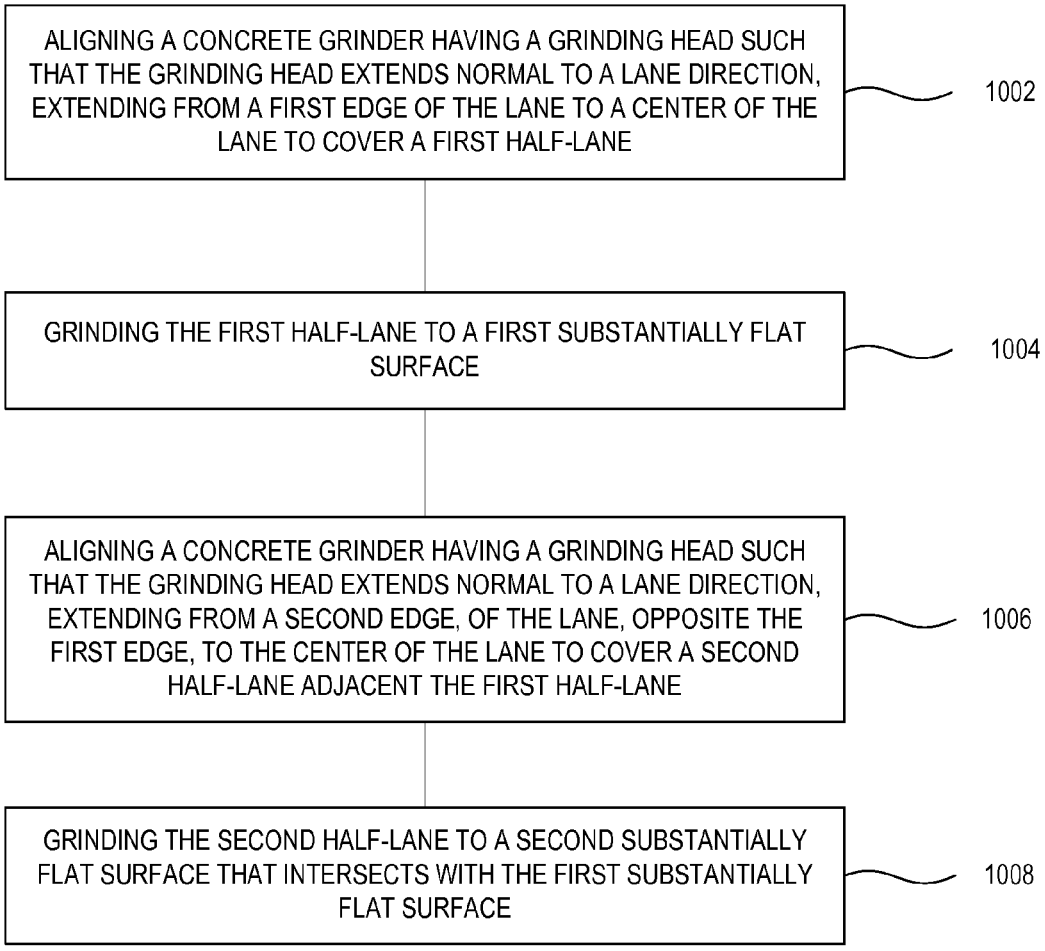
FIG. 10 is a method of grinding a lane in two passes, according to an example.

FIG. 10 is a method of grinding a lane in two passes, according to an example. At 1002, a method can include aligning a concrete grinder having a grinding arbor such that the grinding arbor extends normal to a lane direction, extending from a first edge of the lane to a center of the lane to cover a first half-lane. At 1004, the method can include grinding the first half-lane to a first substantially flat surface. At 1006, the method can include aligning a concrete grinder having a grinding arbor such that the grinding arbor extends normal to a lane direction, extending from a second edge, of the lane, opposite the first edge, to the center of the lane to cover a second half-lane adjacent the first half-lane. At 1008, the method can include grinding the second half-lane to a second substantially flat surface that intersects with the first substantially flat surface.

Optional methods can be used. An optional method can be used wherein grinding the first half-lane to a first substantially flat surface includes grinding the first half-lane to a rough surface, wherein grinding the second half-lane to a second substantially flat surface includes grinding the second half-lane to a rough surface, wherein grinding the first half-lane to a first substantially flat surface includes grinding the first half-lane to a finer surface, wherein grinding the second half-lane to a second substantially flat surface includes grinding the second half-lane to a finer surface. An optional method can be used wherein grinding the first half-lane to a first substantially flat surface includes grinding the first half-lane to a flat surface below a road imperfection. An optional method can be used wherein grinding the first half-lane to a first substantially flat surface includes grinding the first half-lane to a flat surface below a tire groove. An optional method can be used wherein grinding the first half-lane to a first substantially flat surface and grinding the second half-lane to a second substantially flat surface includes forming the half-lane into a concave shape. An optional method can be used wherein grinding the first half-lane to a first substantially flat surface and grinding the second half-lane to a second substantially flat surface includes forming the half-lane into a convex shape.

Figure 11:
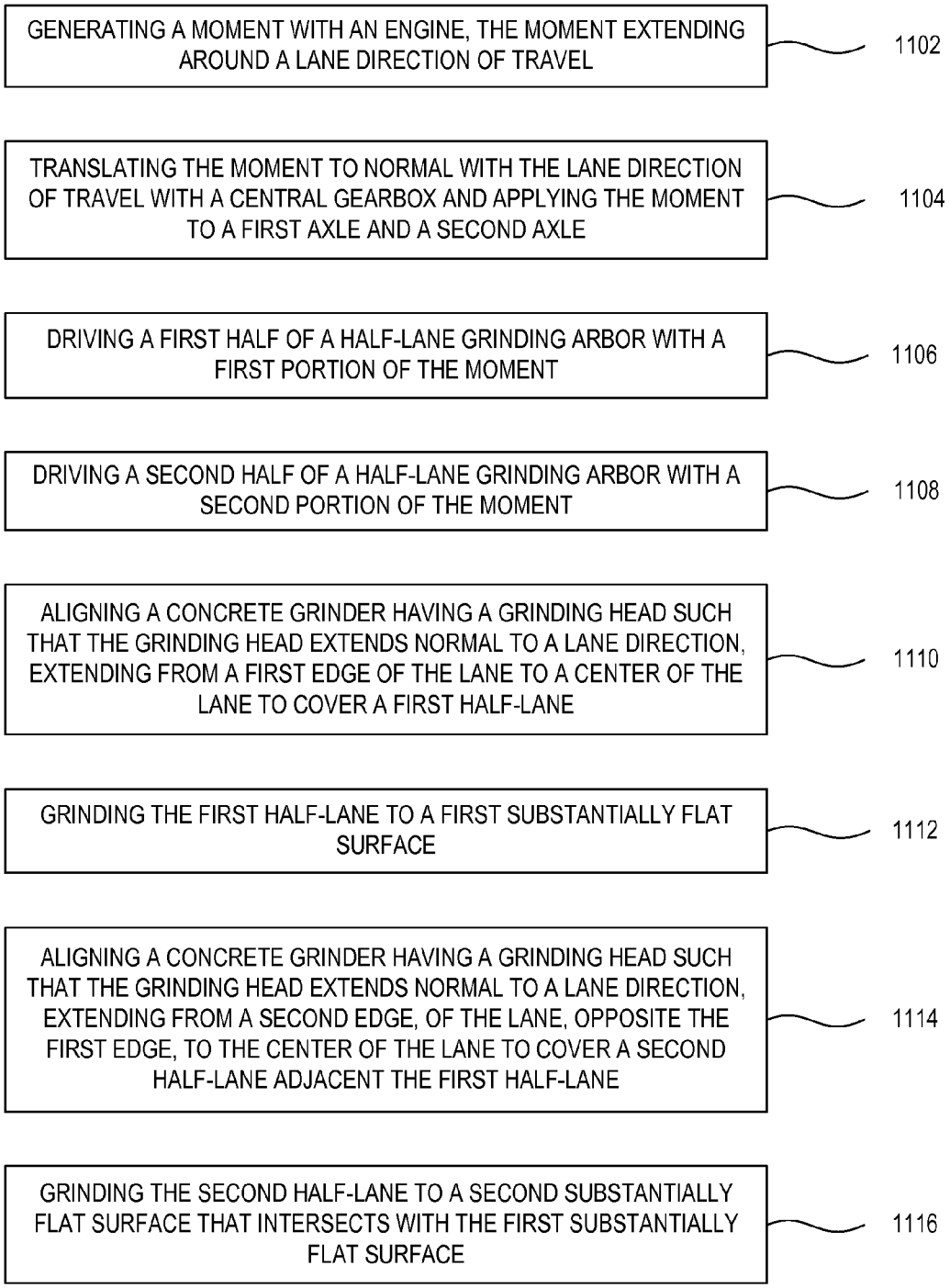
FIG. 11 is a method of grinding a lane with a concrete grinding apparatus including a longitudinally mounted engine, according to an example.

FIG. 11 is a method of grinding a lane with a concrete grinding apparatus including a longitudinally mounted engine, according to an example. At 1102, a method can include generating a moment with an engine, the moment extending around a lane direction of travel. At 1104, the method can include translating the moment to normal with the lane direction of travel with a central gearbox and applying the moment to a first axle and a second axle. At 1106, a method can include driving a first half of a half-lane grinding arbor with a first portion of the moment. At 1108, a method can include driving a second half of a half-lane grinding arbor with a second portion of the moment. At 1110, a method can include aligning a concrete grinder having a grinding arbor such that the grinding arbor extends normal to a lane direction, extending from a first edge of the lane to a center of the lane to cover a first half-lane. At 1112, a method can include grinding the first half-lane to a first substantially flat surface. At 1114, a method can include aligning a concrete grinder having a grinding arbor such that the grinding arbor extends normal to a lane direction, extending from a second edge, of the lane, opposite the first edge, to the center of the lane to cover a second half-lane adjacent the first half-lane. At 1116, a method can include grinding the second half-lane to a second substantially flat surface that intersects with the first substantially flat surface.

An optional method can be used wherein driving the central gearbox includes rotating a driveshaft. An optional method can be used wherein driving the first half of the half-lane grinding arbor includes driving the first half of the half-lane grinding arbor with a first belt drive and driving the second half of the half-lane grinding arbor includes driving the second half of the half-lane grinding arbor with a second belt drive. An optional method can include maintaining a rotational speed of the engine within a defined range and controlling forward movement of the half-lane grinding arbor to maintain a rotational speed of the half-lane grinding arbor. An optional method can be used wherein grinding the first half-lane includes cooling the half-lane grinding arbor with a liquid spray. An optional method can be used wherein grinding the first half-lane includes cooling the half-lane grinding arbor using a vacuum to draw air nearby a rear portion of the half-lane grinding arbor and to draw air nearby a front portion of the half-lane grinding arbor.

Figure 12:
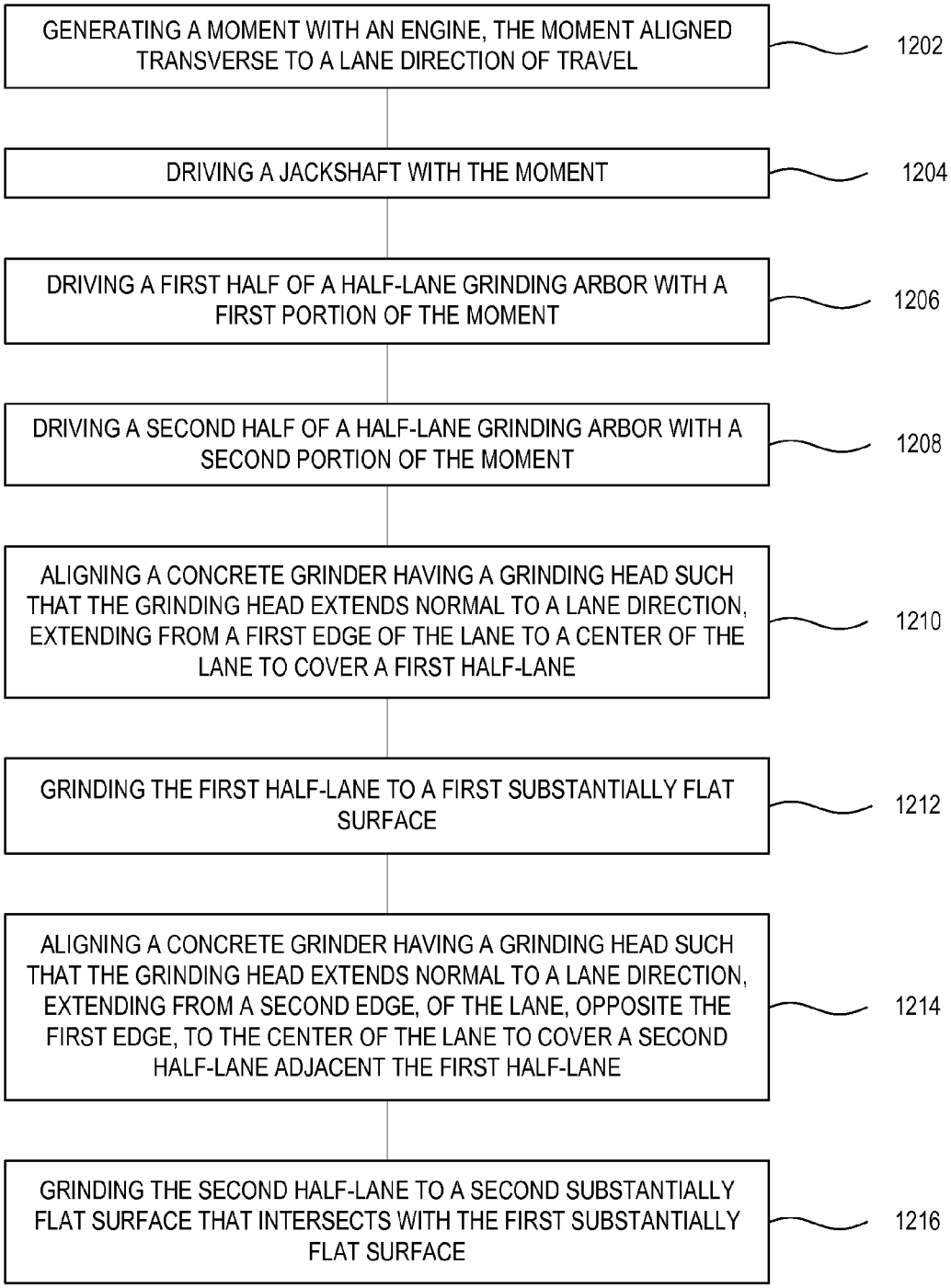
FIG. 12 is a method of grinding a lane with a concrete grinding apparatus including a transversely mounted engine, according to an example.

FIG. 12 is a method of grinding a lane with a concrete grinding apparatus including a transversely mounted engine, according to an example. At 1202, a method can include generating a moment with an engine, the moment aligned transverse to a lane direction of travel. At 1204, a method can include driving a jackshaft with the moment. At 1206, a method can include driving a first half of a half-lane grinding arbor with a first portion of the moment. At 1208, a method can include driving a second half of a half-lane grinding arbor with a second portion of the moment. At 1210, a method can include aligning a concrete grinder having a grinding arbor such that the grinding arbor extends normal to a lane direction, extending from a first edge of the lane to a center of the lane to cover a first half-lane. At 1212, a method can include grinding the first half-lane to a first substantially flat surface. At 1214, a method can include aligning a concrete grinder having a grinding arbor such that the grinding arbor extends normal to a lane direction, extending from a second edge, of the lane, opposite the first edge, to the center of the lane to cover a second half-lane adjacent the first half-lane. At 1216, a method can include grinding the second half-lane to a second substantially flat surface that intersects with the first substantially flat surface.

An optional method can be used wherein driving the jackshaft with a belt drive. An optional method can include driving the jackshaft includes driving the jackshaft with a toothed belt drive. An optional method can include driving the first half of the half-lane grinding arbor includes driving the first half of the half-lane grinding arbor with a first belt drive and driving the second half of the half-lane grinding arbor includes driving the second half of the half-lane grinding arbor with a second belt drive. An optional method can include maintaining a rotational speed of the engine within a defined range and controlling forward movement of the half-lane grinding arbor to maintain a rotational speed of the half-lane grinding arbor. An optional method can be included wherein grinding the first half-lane includes cooling the half-lane grinding arbor with a liquid spray. An optional method can be included wherein grinding the first half-lane includes cooling the half-lane grinding arbor using a vacuum to draw air nearby a rear portion of the half-lane grinding arbor. An optional method can be included wherein grinding the first half-lane includes cooling the half-lane grinding arbor using a vacuum to draw air nearby a front portion of the half-lane grinding arbor.

NOTES AND EXAMPLES

Example 1 can include a concrete grinding apparatus including a grinder frame. Wheels can support the grinding frame. An engine can be mounted transversely across the grinding frame. A half-lane grinding arbor support assembly can be mounted downward from the grinding frame. A half-lane grinding arbor can be mounted to the half-lane grinding arbor support assembly, the half-lane grinding arbor having an arbor with a first end and a second end and a plurality of cutting blades can be mounted along the arbor proximal to one another. A jackshaft support assembly can be mounted to the grinding frame. A jackshaft can be coupled to the jackshaft support assembly and extend transversely across the grinding frame. A jackshaft transmission can be coupled to the engine to translate an engine moment to a jackshaft moment parallel the engine moment. A first grinding arbor transmission can be mounted to the grinding frame and can be coupled between a first end of the jackshaft and the grinding arbor to translate the jackshaft moment to a first half-lane grinding arbor moment parallel the engine moment the jackshaft moment. A second grinding arbor transmission can be mounted to the grinding frame and can be coupled between a second end of the jackshaft and the grinding arbor to translate the jackshaft moment to a second half-lane grinding arbor moment parallel the engine moment the jackshaft moment.

Example 2 can include any of the subject matter of any of claim 1, wherein the jackshaft transmission includes a belt drive.

Example 3 can include any of the subject matter of any of the previous examples, comprising a tensioner that can be that can be disposed against the belt to tension the belt.

Example 4 can include any of the subject matter of any of the previous examples, wherein the first grinding arbor transmission includes a belt drive.

Example 5 can include any of the subject matter of any of the previous examples, comprising a tensioner that can be disposed against the belt to tension the belt.

Example 6 can include any of the subject matter of any of the previous examples, wherein the second grinding arbor transmission includes a belt drive.

Example 7 can include any of the subject matter of any of the previous examples, comprising a tensioner that can be disposed against the belt to tension the belt.

Example 8 can include any of the subject matter of any of the previous examples, wherein the grinding arbor, the jackshaft and the engine each rotate around parallel axes.

Example 9 can include any of the subject matter of any of the previous examples, comprising a grinding frame, wheels supporting the grinding frame, an engine can be mounted to the grinding frame, a transmission can be mounted to the grinding frame and can be coupled to the engine to translate an engine moment to opposite transverse sides of the grinding frame, a half-lane grinding arbor support assembly can be mounted downward from the grinding frame, a half-lane grinding arbor can be mounted to the half-lane grinding arbor support assembly, the half-lane grinding arbor having an arbor with a first end and a second end and a plurality of cutting blades can be mounted along the arbor proximal to one another, a first grinding arbor transmission can be mounted to the grinding frame and can be coupled between a first end of the transmission and the grinding arbor to translate the engine moment to a first half-lane grinding arbor moment, a second grinding arbor transmission can be mounted to the grinding frame and can be coupled between a second end of the transmission and the grinding arbor to translate the engine moment to a second half-lane grinding arbor moment, and a controller to maintain a rotational speed of the engine within a defined range and controlling forward movement of the half-lane grinding arbor to maintain a rotational speed of the half-lane grinding arbor.

Example 10 can include any of the subject matter of any of the previous examples, wherein the engine can be mounted longitudinally with respect to the grinding frame.

Example 11 can include any of the subject matter of any of the previous examples, comprising a driveshaft coupling the engine to the transmission.

Example 12 can include any of the subject matter of any of the previous examples, wherein the transmission is to translate the engine moment from around a longitudinal axis of the grinding frame, parallel a direction of lane travel, to transverse the longitudinal axis.

Example 13 can include any of the subject matter of any of the previous examples, wherein the transmission includes a central ring and pinion, with the pinion can be coupled to the driveshaft to drive a pair of axles extending opposite sides of the grinding frame to each of the first grinding arbor transmission and the second grinding arbor transmission.

Example 14 can include any of the subject matter of any of the previous examples, wherein each of the first grinding arbor transmission and the second grinding arbor transmission are belt driven by respective ones of the pair of axles.

Example 15 can include any of the subject matter of any of the previous examples, wherein the transmission includes a hydraulic pump, and each of the first grinding arbor transmission and the second grinding arbor transmission include respective hydraulic motors each can be coupled to the hydraulic pump.

Example 16 can include any of the subject matter of any of the previous examples, comprising a grinding frame, wheels supporting the grinding frame, an engine can be mounted transversely across the grinding frame, a half-lane grinding arbor support assembly can be mounted downward from the grinding frame, a half-lane grinding arbor can be mounted to the half-lane grinding arbor support assembly, the half-lane grinding arbor having an arbor with a first end and a second end and a plurality of cutting blades can be mounted along the arbor proximal to one another, wherein the half-lane grinding arbor support is vertically adjustable in operation, a second frame can be coupled to the grinding frame via a pivot, the second frame extending over the grinding frame, the second frame including a prime mover to drive wheels of the second frame to move the concrete grinding apparatus, an actuator can be coupled between the second frame and the grinding frame, with the second frame bearing down on the actuator and the grinding frame to urge the grinding frame downward from the second frame, a jackshaft support assembly can be mounted to the grinding frame, a jackshaft can be coupled to the jackshaft support assembly and extending transversely across the grinding frame, a jackshaft transmission can be coupled to the engine to translate an engine moment to a jackshaft moment parallel the engine moment, a first grinding arbor transmission can be mounted to the grinding frame and can be coupled between a first end of the jackshaft and the grinding arbor to translate the jackshaft moment to a first half-lane grinding arbor moment parallel the engine moment the jackshaft moment, and a second grinding arbor transmission can be mounted to the grinding frame and can be coupled between a second end of the jackshaft and the grinding arbor to translate the jackshaft moment to a second half-lane grinding arbor moment parallel the engine moment the jackshaft moment.

Example 17 can include any of the subject matter of any of the previous examples, comprising a controller to maintain a rotational speed of the engine within a defined range and to control the speed of the drive wheels to maintain a rotational speed of the half-lane grinding arbor.

Example 18 can include any of the subject matter of any of the previous examples, comprising an operator seat positioned at a side of the grinding frame near the grinding arbor and behind the grinding arbor.

Example 19 can include any of the subject matter of any of the previous examples, wherein the jackshaft transmission includes a belt drive.

Example 20 can include any of the subject matter of any of the previous examples, wherein the first grinding arbor transmission includes a belt drive and the second grinding arbor transmission includes a belt drive.

Example 21 can include any of the subject matter of any of the previous examples, comprising a grinding frame, wheels supporting the grinding frame, an engine can be mounted to the grinding frame, a transmission can be mounted to the grinding frame and can be coupled to the engine to translate an engine moment to opposite transverse sides of the grinding frame, a grinding arbor support assembly can be mounted downward from the grinding frame, a grinding arbor can be mounted to the grinding arbor support assembly, the grinding arbor having an arbor with a first end and a second end and a plurality of cutting blades can be mounted along the arbor proximal to one another, a first grinding arbor transmission can be mounted to the grinding frame and can be coupled between a first end of the transmission and the grinding arbor to translate the engine moment to a first grinding arbor moment, and a second grinding arbor transmission can be mounted to the grinding frame and can be coupled between a second end of the transmission and the grinding arbor to translate the engine moment to a second grinding arbor moment, a vacuum shroud positioned proximal a rear of the grinding arbor, a debris collector in fluid communication with the vacuum shroud, and a centrifugal vacuum pump to apply a vacuum to the debris collector and thereby to the vacuum shroud, wherein the vacuum shroud is positioned near the grinding arbor to draw air across the grinding arbor to cool the grinding arbor and to collect debris from the grinding arbor.

Example 22 can include any of the subject matter of any of the previous examples, wherein the vacuum shroud is disposed behind the grinding arbor.

Example 23 can include any of the subject matter of any of the previous examples, wherein the vacuum shroud is a first vacuum shroud, and comprising a second vacuum shroud disposed in front of the grinding arbor in fluid communication with the debris collector.

Example 24 can include any of the subject matter of any of the previous examples, wherein the second vacuum shroud can be coupled in fluid communication with the first vacuum shroud via a conduit to communicate vacuum from the debris collector, through the first shroud to the second shroud.

Example 25 can include any of the subject matter of any of the previous examples, wherein the conduit is of a smaller diameter than a main conduit coupling the first vacuum shroud to the debris collector.

Example 26 can include any of the subject matter of any of the previous examples, comprising a liquid sprayer to spray a rear portion of the grinding arbor with coolant.

Example 27 can include any of the subject matter of any of the previous examples, wherein the liquid sprayer is a water sprayer.

Example 28 can include any of the subject matter of any of the previous examples, comprising a trash pump can be coupled to an exit of the debris collector to pump debris away from the debris collector.

Example 29 can include any of the subject matter of any of the previous examples, comprising a trash pump can be coupled to an exit of the debris collector to pump liquid away from the debris collector.

Example 30 can include any of the subject matter of any of the previous examples, wherein the centrifugal vacuum pump includes a squirrel cage fan.

Example 31 can include any of the subject matter of any of the previous examples, wherein the vacuum shroud is laterally centered on the grinding arbor.

Example 32 can include any of the subject matter of any of the previous examples, wherein the transmission includes a hydraulic pump, and comprising a hydraulic motor can be coupled to the hydraulic pump to power the centrifugal vacuum pump.

Example 33 can include any of the subject matter of any of the previous examples, comprising a filter can be coupled between the centrifugal vacuum pump and the debris collector.

Example 34 can include any of the subject matter of any of the previous examples comprising a grinding frame, wheels supporting the grinding frame, an engine can be mounted transversely across the grinding frame, a half-lane grinding arbor support assembly can be mounted downward from the grinding frame, a half-lane grinding arbor can be mounted to the half-lane grinding arbor support assembly, the half-lane grinding arbor having an arbor with a first end and a second end and a plurality of cutting blades can be mounted along the arbor proximal to one another, a jackshaft support assembly can be mounted to the grinding frame, a jackshaft can be coupled to the jackshaft support assembly and extending transversely across the grinding frame, a jackshaft transmission can be coupled to the engine to translate an engine moment to a jackshaft moment parallel the engine moment, a first grinding arbor transmission can be mounted to the grinding frame and can be coupled between a first end of the jackshaft and the grinding arbor to translate the jackshaft moment to a first half-lane grinding arbor moment parallel the engine moment the jackshaft moment, and a second grinding arbor transmission can be mounted to the grinding frame and can be coupled between a second end of the jackshaft and the grinding arbor to translate the jackshaft moment to a second half-lane grinding arbor moment parallel the engine moment the jackshaft moment. A vacuum shroud can positioned proximal a rear of the grinding arbor, a debris collector in fluid communication with the vacuum shroud, and a centrifugal vacuum pump to apply a vacuum to the debris collector and thereby to the vacuum shroud, wherein the vacuum shroud is positioned to draw air across the grinding arbor to cool the grinding arbor and to collect debris from the grinding arbor.

Example 35 can include any of the subject matter of any of the previous examples, comprising a hydraulic pump can be coupled to the engine and a hydraulic motor can be coupled to the hydraulic pump to power the centrifugal vacuum pump.

Example 36 can include any of the subject matter of any of the previous examples, wherein the vacuum shroud is disposed behind the grinding arbor.

Example 37 can include any of the subject matter of any of the previous examples, wherein the vacuum shroud is a first vacuum shroud, and comprising a second vacuum shroud disposed in front of the grinding arbor in fluid communication with the debris collector.

Example 38 can include any of the subject matter of any of the previous examples comprising a grinding frame, wheels supporting the grinding frame, an engine can be mounted to the grinding frame, a transmission can be mounted to the grinding frame and can be coupled to the engine to translate an engine moment to opposite transverse sides of the grinding frame, a half-lane grinding arbor support assembly can be mounted downward from the grinding frame, a half-lane grinding arbor can be mounted to the half-lane grinding arbor support assembly, the half-lane grinding arbor having an arbor with a first end and a second end and a plurality of cutting blades can be mounted along the arbor proximal to one another, a first grinding arbor transmission can be mounted to the grinding frame and can be coupled between a first end of the transmission and the grinding arbor to translate the engine moment to a first half-lane grinding arbor moment, and a second grinding arbor transmission can be mounted to the grinding frame and can be coupled between a second end of the transmission and the grinding arbor to translate the engine moment to a second half-lane grinding arbor moment, and a vacuum shroud positioned proximal a rear of the grinding arbor, a debris collector in fluid communication with the vacuum shroud, and a centrifugal vacuum pump to apply a vacuum to the debris collector and thereby to the vacuum shroud, wherein the vacuum shroud is positioned to draw air across the grinding arbor to cool the grinding arbor and to collect debris from the grinding arbor.

Example 39 can include any of the subject matter of any of the previous examples, wherein the transmission includes a hydraulic pump, and comprising a hydraulic motor can be coupled to the hydraulic pump to power the centrifugal vacuum pump.

Example 40 can include any of the subject matter of any of the previous examples, wherein the vacuum shroud is a first vacuum shroud that is disposed behind the grinding arbor, and comprising a second vacuum shroud disposed in front of the grinding arbor in fluid communication with the debris collector.

Example 41 can include any of the subject matter of any of the previous examples comprising a method of grinding a road lane in two passes, comprising aligning a concrete grinder having a grinding arbor such that the grinding arbor extends normal to a lane direction, extending from a first edge of the lane to a center of the lane to cover a first half-lane, grinding the first half-lane to a first substantially flat surface, aligning a concrete grinder having a grinding arbor such that the grinding arbor extends normal to a lane direction, extending from a second edge, of the lane, opposite the first edge, to the center of the lane to cover a second half-lane adjacent the first half-lane, and grinding the second half-lane to a second substantially flat surface that intersects with the first substantially flat surface.

Example 42 can include any of the subject matter of any of the previous examples, wherein grinding the first half-lane to a first substantially flat surface includes grinding the first half-lane to a rough surface, wherein grinding the second half-lane to a second substantially flat surface includes grinding the second half-lane to a rough surface, wherein grinding the first half-lane to a first substantially flat surface includes grinding the first half-lane to a finer surface, wherein grinding the second half-lane to a second substantially flat surface includes grinding the second half-lane to a finer surface.

Example 43 can include any of the subject matter of any of the previous examples, wherein grinding the first half-lane to a first substantially flat surface includes grinding the first half-lane to a flat surface below a road imperfection.

Example 44 can include any of the subject matter of any of the previous examples, wherein grinding the first half-lane to a first substantially flat surface includes grinding the first half-lane to a flat surface below a tire groove.

Example 45 can include any of the subject matter of any of the previous examples, wherein grinding the first half-lane to a first substantially flat surface and grinding the second half-lane to a second substantially flat surface includes forming the half-lane into a concave shape.

Example 46 can include any of the subject matter of any of the previous examples, wherein grinding the first half-lane to a first substantially flat surface and grinding the second half-lane to a second substantially flat surface includes forming the half-lane into a convex shape.

Example 47 can include any of the subject matter of any of the previous examples comprising a method of grinding a road lane in two passes, comprising generating a moment with an engine, the moment extending around a lane direction of travel, translating the moment to normal with the lane direction of travel with a central gearbox and applying the moment to a first axle and a second axle, driving a first half of a half-lane grinding arbor with a first portion of the moment, driving a second half of a half-lane grinding arbor with a second portion of the moment, aligning a concrete grinder having a grinding arbor such that the grinding arbor extends normal to a lane direction, extending from a first edge of the lane to a center of the lane to cover a first half-lane, grinding the first half-lane to a first substantially flat surface, aligning a concrete grinder having a grinding arbor such that the grinding arbor extends normal to a lane direction, extending from a second edge, of the lane, opposite the first edge, to the center of the lane to cover a second half-lane adjacent the first half-lane, and grinding the second half-lane to a second substantially flat surface that intersects with the first substantially flat surface.

Example 48 can include any of the subject matter of any of the previous examples, wherein driving the central gearbox includes rotating a driveshaft.

Example 49 can include any of the subject matter of any of the previous examples, wherein driving the first half of the half-lane grinding arbor includes driving the first half of the half-lane grinding arbor with a first belt drive and driving the second half of the half-lane grinding arbor includes driving the second half of the half-lane grinding arbor with a second belt drive.

Example 50 can include any of the subject matter of any of the previous examples, comprising maintaining a rotational speed of the engine within a defined range and controlling forward movement of the half-lane grinding arbor to maintain a rotational speed of the half-lane grinding arbor.

Example 51 can include any of the subject matter of any of the previous examples, wherein grinding the first half-lane includes cooling the half-lane grinding arbor with a liquid spray.

Example 52 can include any of the subject matter of any of the previous examples, wherein grinding the first half-lane includes cooling the half-lane grinding arbor using a vacuum to draw air nearby a rear portion of the half-lane grinding arbor and to draw air nearby a front portion of the half-lane grinding arbor.

Example 53 can include any of the subject matter of any of the previous examples comprising a method of grinding a road lane in two passes, comprising generating a moment with an engine, the moment aligned transverse to a lane direction of travel, driving a jackshaft with the moment, driving a first half of a half-lane grinding arbor with a first portion of the moment, driving a second half of a half-lane grinding arbor with a second portion of the moment, aligning a concrete grinder having a grinding arbor such that the grinding arbor extends normal to a lane direction, extending from a first edge of the lane to a center of the lane to cover a first half-lane, grinding the first half-lane to a first substantially flat surface, aligning a concrete grinder having a grinding arbor such that the grinding arbor extends normal to a lane direction, extending from a second edge, of the lane, opposite the first edge, to the center of the lane to cover a second half-lane adjacent the first half-lane, and grinding the second half-lane to a second substantially flat surface that intersects with the first substantially flat surface.

Example 54 can include any of the subject matter of any of the previous examples, wherein driving the jackshaft includes driving the jackshaft with a belt drive.

Example 55 can include any of the subject matter of any of the previous examples, wherein driving the jackshaft includes driving the jackshaft with a toothed belt drive.

Example 56 can include any of the subject matter of any of the previous examples, wherein driving the first half of the half-lane grinding arbor includes driving the first half of the half-lane grinding arbor with a first belt drive and driving the second half of the half-lane grinding arbor includes driving the second half of the half-lane grinding arbor with a second belt drive.

Example 57 can include any of the subject matter of any of the previous examples, comprising maintaining a rotational speed of the engine within a defined range and controlling forward movement of the half-lane grinding arbor to maintain a rotational speed of the half-lane grinding arbor.

Example 58 can include any of the subject matter of any of the previous examples, wherein grinding the first half-lane includes cooling the half-lane grinding arbor with a liquid spray.

Example 59 can include any of the subject matter of any of the previous examples, wherein grinding the first half-lane includes cooling the half-lane grinding arbor using a vacuum to draw air nearby a rear portion of the half-lane grinding arbor.

Example 60 can include any of the subject matter of any of the previous examples, wherein grinding the first half-lane includes cooling the half-lane grinding arbor using a vacuum to draw air nearby a front portion of the half-lane grinding arbor.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in that may be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is to allow the reader to quickly ascertain the nature of the technical disclosure, for example, to comply with 37 C.F.R. §1.72(b) in the United States of America. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A concrete removal apparatus comprising:

an arbor frame;

wheels supporting the arbor frame;

an engine mounted transversely across the arbor frame;

a support assembly mounted downward from the arbor frame;

a concrete removal device mounted to the support assembly, the concrete removal device having an arbor with a first end and a second end and one or more cutting blades mounted along the arbor;

a jackshaft support assembly mounted to the arbor frame;

a jackshaft coupled to the jackshaft support assembly and extending transversely across the arbor frame;

a jackshaft transmission coupled to the engine to translate an engine moment to a jackshaft moment parallel the engine moment;

a first arbor transmission mounted to the arbor frame and coupled between a first end of the jackshaft and the arbor to translate the jackshaft moment to a first arbor moment parallel the engine moment the jackshaft moment; and a second arbor transmission mounted to the arbor frame and coupled between a second end of the jackshaft and the arbor to translate the jackshaft moment to a second arbor moment parallel the engine moment the jackshaft moment.

2. The concrete removal apparatus of claim 1, wherein the jackshaft transmission includes a belt drive.

3. The concrete removal apparatus of claim 2, further including a tensioner that can be that can be disposed against a belt of the belt drive to tension the belt.

4. The concrete removal apparatus of claim 1, wherein the first arbor transmission includes a belt drive.

5. The concrete removal apparatus of claim 1, wherein the second arbor transmission includes a belt drive.

6. The concrete removal apparatus of claim 1, wherein the arbor, the jackshaft and the engine each rotate around parallel axes.

7. The concrete removal apparatus of claim 1, wherein the arbor includes a plurality of cutting blades located side by side to form a grinding arbor.

8. The concrete removal apparatus of claim 7, further comprising a vacuum shroud positioned proximal a rear of the grinding arbor.

9. The concrete removal apparatus of claim 8, further comprising a debris collector in fluid communication with the vacuum shroud, and a centrifugal vacuum pump to apply a vacuum to the debris collector and thereby to the vacuum shroud, wherein the vacuum shroud is positioned near the grinding arbor to draw air across the grinding arbor to cool the grinding arbor and to collect debris from the grinding arbor.

* * * * *